US007967415B2

(12) United States Patent
Asauchi et al.

(10) Patent No.: US 7,967,415 B2
(45) Date of Patent: Jun. 28, 2011

(54) PRINTING MATERIAL CONTAINER

(75) Inventors: Noboru Asauchi, Yamagata-mura (JP); Akihisa Wanibe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 672 days.

(21) Appl. No.: 11/572,880

(22) PCT Filed: Aug. 30, 2005

(86) PCT No.: PCT/JP2005/016205

§ 371 (c)(1),
(2), (4) Date: Jun. 25, 2008

(87) PCT Pub. No.: WO2006/025578

PCT Pub. Date: Mar. 9, 2006

(65) Prior Publication Data

US 2008/0259135 A1 Oct. 23, 2008

(30) Foreign Application Priority Data

Sep. 1, 2004 (JP) ..... 2004-253788

(51) Int. Cl.
*B41J 2/14* (2006.01)
*B41J 2/195* (2006.01)
*B41J 2/175* (2006.01)

(52) U.S. Cl. ..... 347/50; 347/7; 347/86

(58) Field of Classification Search ..... 347/7, 49–50, 347/86; 73/290 R

See application file for complete search history.

(56) References Cited

U.S. PATENT DOCUMENTS

| | | | | |
|---|---|---|---|---|
| 5,363,134 | A * | 11/1994 | Barbehenn et al. | 347/49 |
| 5,610,635 | A | 3/1997 | Murray et al. | |
| 5,711,619 | A * | 1/1998 | Kaneko et al. | 400/74 |
| 6,000,773 | A * | 12/1999 | Murray et al. | 347/7 |
| 6,039,428 | A | 3/2000 | Juve | |
| 6,536,871 | B1 * | 3/2003 | Haddick et al. | 347/50 |
| 6,550,902 | B2 | 4/2003 | Shinada et al. | |
| 6,729,184 | B2 * | 5/2004 | Tsukada et al. | 73/290 V |
| 7,219,985 | B2 | 5/2007 | Shinada et al. | |
| 2002/0167574 | A1 | 11/2002 | Shinada et al. | |
| 2002/0171700 | A1 | 11/2002 | Shinada et al. | |

(Continued)

FOREIGN PATENT DOCUMENTS

EP 0 412 459 A2 2/1991

(Continued)

OTHER PUBLICATIONS

English translation of Written Opinion of the International Searching Authority issued in PCT/JP2005/016205 (Mar. 20, 2007).

(Continued)

*Primary Examiner* — Anh T. N. Vo

(74) *Attorney, Agent, or Firm* — Stroock & Stroock & Lavan LLP

(57) ABSTRACT

Ink cartridge 70 is attached to cartridge holder 62 of printing apparatus 20 by being inserted in a predetermined insertion direction R until it is touching locating member. Ink cartridge 70 includes a plurality of low voltage circuit terminals 111-113 and a plurality of high voltage circuit terminals 114, 115 on body 71. Low voltage circuit terminals 111-113 are arranged so as to form row A2 orthogonal to insertion direction R. High voltage circuit terminals 114, 115 are arranged so as to form row B2 orthogonal to insertion direction R. Row B2 is arranged further towards the insertion direction R side than row A2.

11 Claims, 7 Drawing Sheets

U.S. PATENT DOCUMENTS

| | | | | |
|---|---|---|---|---|
| 2002/0180823 | A1 | 12/2002 | Shinada et al. | |
| 2003/0043216 | A1 | 3/2003 | Usui et al. | |
| 2003/0058296 | A1 | 3/2003 | Shinada et al. | |
| 2003/0085969 | A1 | 5/2003 | Shinada et al. | |
| 2004/0155913 | A1 | 8/2004 | Kosugi et al. | |
| 2005/0195255 | A1 | 9/2005 | Shinada et al. | |
| 2005/0270315 | A1 | 12/2005 | Yamamoto | |
| 2006/0033790 | A1 | 2/2006 | Shinada et al. | |
| 2006/0119677 | A1 | 6/2006 | Shinada et al. | |
| 2006/0203050 | A1 | 9/2006 | Shinada et al. | |
| 2007/0126770 | A1 | 6/2007 | Asauchi | 347/19 |
| 2007/0149044 | A1 | 6/2007 | Asauchi | |

FOREIGN PATENT DOCUMENTS

| | | | |
|---|---|---|---|
| EP | 0 997 297 | A1 | 5/2000 |
| EP | 1 114 726 | A | 7/2001 |
| EP | 1 188 567 | A2 | 3/2002 |
| EP | 1 219 437 | A2 | 7/2002 |
| EP | 1 279 503 | A2 | 1/2003 |
| EP | 1 281 523 | A2 | 2/2003 |
| EP | 0 805 028 | B1 | 7/2003 |
| EP | 1 462 262 | A1 | 9/2004 |
| EP | 1 598 198 | A2 | 11/2005 |
| EP | 1 792 733 | | 6/2007 |
| GB | 2 369 801 | A | 6/2002 |
| GB | 2 424 623 | A | 10/2006 |
| JP | 06-320818 | A | 11/1994 |
| JP | 09 320750 | | 12/1997 |
| JP | 10-086357 | A | 4/1998 |
| JP | 11-312554 | A | 11/1999 |
| JP | 2001-147146 | A | 5/2001 |
| JP | 2002-154222 | A | 5/2002 |
| JP | 2003-103796 | A | 4/2003 |
| JP | 2003-152297 | A | 5/2003 |
| JP | 2004-050573 | A | 2/2004 |
| JP | 2005-343037 | A | 12/2005 |
| JP | 2006-100398 | A | 4/2006 |
| WO | 98/55324 | A1 | 12/1998 |
| WO | 2006/025578 | A1 | 3/2006 |

OTHER PUBLICATIONS

New Zealand Examination Report for NZ patent appln. No. 552094 (Dec. 19, 2006).

United Kingdom Search Report for UK patent appln. No. GB0625839.6 (Apr. 20, 2007).

Extended European Search Report for European patent appln. No. 06256540.3 (May 4, 2007).

International Search Report and Written Opinion for international patent appln. No. PCT/JP2006/325448 (May 8, 2007).

Allowed claims corresponding to Application No. 2002-167574.

Allowed claims corresponding to Application No. 2002-171700.

Allowed claims corresponding to Application No. 2002-180823.

Allowed claims corresponding to Application No. 2003-58296.

Allowed claims corresponding to Application No. 2006-33790.

Allowed claims corresponding to Application No. 2006-119677.

Search Report from British patent appln. No. GB0804416.6 (May 30, 2008).

European Search Report (Joosting, Jun. 10, 2009, for corresponding EP App. No. 05781576.3).

Australian Search and Examination Report (May 8, 2007) and letter from Singapore Patent Office forwarding same (Jun. 4, 2007).

Search Report for PCT/JP2005/016205 (Nov. 22, 2005).

U.S. Appl. No. 11/611,641, filed Dec. 15, 2006, Asauchi.

* cited by examiner (a)

(b)

PRINTING MATERIAL CONTAINER

TECHNICAL FIELD

The present invention relates to a printing material container, and specifically relates to the technique to prevent the accidental contacts between terminals disposed on a printing material container.

BACKGROUND ART

A ink cartridge attachable to a printing apparatus, for example, ink jet printer may have various functions, for example, ink information holding function or remaining ink level detection function. In this case, the ink cartridge may have to have electrical interconnection with the printing apparatus. For example, there is a case that terminals are disposed on both ink cartridge side and printing apparatus side, and when the ink cartridge is attached to the printing apparatus, terminals of both sides contact each other. And the structure of ink cartridge to prevent damage by shorting to data storage medium mounted on the ink cartridge is known, wherein the shorting is caused by adhesion of ink droplet to terminals to connect the data storage medium to the printing apparatus.

However, in above technology, in the case that at least two kinds of terminals to which different voltages are respectively applied are disposed on the ink cartridge, there is a risk that the shorting between the terminals to which different voltages are applied occurs and the occurred shouting give the damage to the ink cartridge or the printing apparatus. The shorting between the terminals to which different voltages are applied is, for example, the accidental contact between terminal to which high voltage is applied and terminal to which low voltage is applied. Such a problem is not only with ink cartridge but also with other container contains other printing material, for example, toner.

DISCLOSURE OF THE INVENTION

An object of the present invention, which is intended to address the problem noted above, is to prevent the shorting between the terminals to which different voltages are applied in printing material container on which at least two kinds of terminals to which different voltages are respectively applied are disposed.

To achieve the above object, a first aspect of the invention provides a printing material container attachable to a printing apparatus by being inserted in a predetermined insertion direction. The printing material container pertaining to the first aspect of the invention is characterized by comprising:

a body that contains a printing material;

a plurality of low voltage circuit terminals arranged so as to form a first row on the body, wherein the first row is orthogonal to the insertion direction, wherein the plurality of low voltage circuit terminals respectively contact a plurality of terminals of a low voltage circuit provided with the printing apparatus when the printing material container is attached to the printing apparatus; and a plurality of high voltage circuit terminals arranged so as to form a second row on the body, wherein the second row is orthogonal to the insertion direction and are arranged further towards the insertion direction than the first row, wherein the plurality of high voltage circuit terminals respectively contact a plurality of terminals of a high voltage circuit provided with the printing apparatus when the printing material container is attached to the printing apparatus.

According to the printing material container pertaining to the first aspect of the invention, the low voltage circuit terminals are arranged so as to form the first row orthogonal to the insertion direction, the high voltage circuit terminals are arranged so as to form the second row orthogonal to the insertion direction, and the high voltage circuit terminals are arranged further towards the insertion direction side than the first row. In the result, during the motion of insertion, during the motion of release, or in imperfect insertion state, even if the container moves from fixing point in backward direction of the insertion direction, the low voltage circuit terminals may not accidentally contact the terminals of a high voltage circuit, because the low voltage circuit terminals of the container back away from the terminals of a high voltage circuit of the printing apparatus. Therefore, it is possible to prevent the shorting between the terminals to which different voltages are applied.

A second aspect of the invention provides a printing material container attachable to a printing apparatus by being inserted in a predetermined insertion direction. The printing material container pertaining to the second aspect of the invention is characterized by comprising:

a body that contains a printing material;

a plurality of low voltage circuit terminals arranged so as to form a first row on the body, wherein the first row is parallel to the insertion direction, wherein the plurality of low voltage circuit terminals respectively contact a plurality of terminals of a low voltage circuit provided with the printing apparatus when the printing material container is attached to the printing apparatus; and a plurality of high voltage circuit terminals arranged so as to form a second row on the body, wherein the second row is parallel to the insertion direction and is different from first row, wherein the plurality of high voltage circuit terminals respectively contact a plurality of terminals of a high voltage circuit provided with the printing apparatus when the printing material container is attached to the printing apparatus.

According to the printing material container pertaining to the second aspect of the invention, low voltage circuit terminals are arranged so as to form the first row parallel to the insertion direction, the high voltage circuit terminals are arranged so as to form the second row parallel to the insertion direction, the second low being different from the first row. In the result, during the motion of insertion, during the motion of release, or in imperfect insertion state, even if the container moves from fixing point in backward direction of the insertion direction, the high voltage circuit terminal of the container or the terminal for high voltage circuit of the printing apparatus may not accidentally contact the low voltage circuit terminal of the container or the terminal of a low voltage circuit of the printing apparatus. Therefore, it is possible to prevent the shorting between the terminals to which different voltages are applied.

A third aspect of the invention provides a printing material container attachable to a printing apparatus by being inserted in a predetermined insertion direction. The printing material container pertaining to the third aspect of the invention is characterized by comprising:

a body that contains a printing material;

a plurality of low voltage circuit terminals arranged so as to form a first row on the body, wherein the first row is parallel to the insertion direction, wherein the plurality of low voltage circuit terminals respectively contact a plurality of terminals of a low voltage circuit provided with the printing apparatus when the printing material container is attached to the printing apparatus; and a plurality of high voltage circuit terminals arranged on the body, wherein the plurality of high voltage circuit terminals respectively contact a plurality of terminals of a high voltage circuit provided with the printing apparatus when the printing material container is attached to the printing apparatus, wherein the plurality of high voltage circuit terminals include one earth terminal, wherein the one earth terminal is arranged on the first row and is arranged further towards the insertion direction side than the plurality of low voltage circuit terminals, wherein a other terminal among the plurality of high voltage circuit terminals except the one earth terminal is arranged so as to form a second row that is parallel to the insertion direction and is different from first row, wherein the one earth terminal is connected with the other terminal forming the second row via a capacitor.

According to the printing material container pertaining to the third aspect of the invention, during the motion of insertion, during the motion of release, or in imperfect insertion state, when the container moves from fixing point in backward direction of the insertion direction, the one earth terminal may contact the terminal for the low voltage circuit of the printing apparatus and, via the one earth terminal, the high voltage may be instantaneously applied from the high voltage circuit terminal to the terminal for low voltage circuit of the printing apparatus. But, because there is the capacitor between the earth terminal and the high voltage circuit terminal and the capacitor is charging, the applied voltage to the terminal for low voltage circuit of the printing apparatus may be rapidly decreased. Therefore it is possible to prevent the damage to the law voltage circuit by such a contact.

A fourth aspect of the invention provides a printing apparatus. The printing apparatus pertaining to the fourth aspect of the invention is characterized by comprising a printing material container holder having terminals respectively corresponding to the plurality of low voltage terminals and the plurality of high voltage terminals provided with a printing material container according to any of claim 1 to claim 9.

According to the printing material container pertaining to the third aspect of the invention, the similar functions and effects as the printing material containers of the first, second and third aspects of the invention can be obtained. In addition, the printing apparatus of the fourth aspect of the invention may also be actualized in a variety of aspects in a way similar to the printing material containers of the first, second and third aspects of the invention.

BEST MODES OF CARRYING OUT THE INVENTION

Following, the image processing device of the present invention is described based on the embodiments with reference to drawings.

A. First Embodiment

Figure 1:
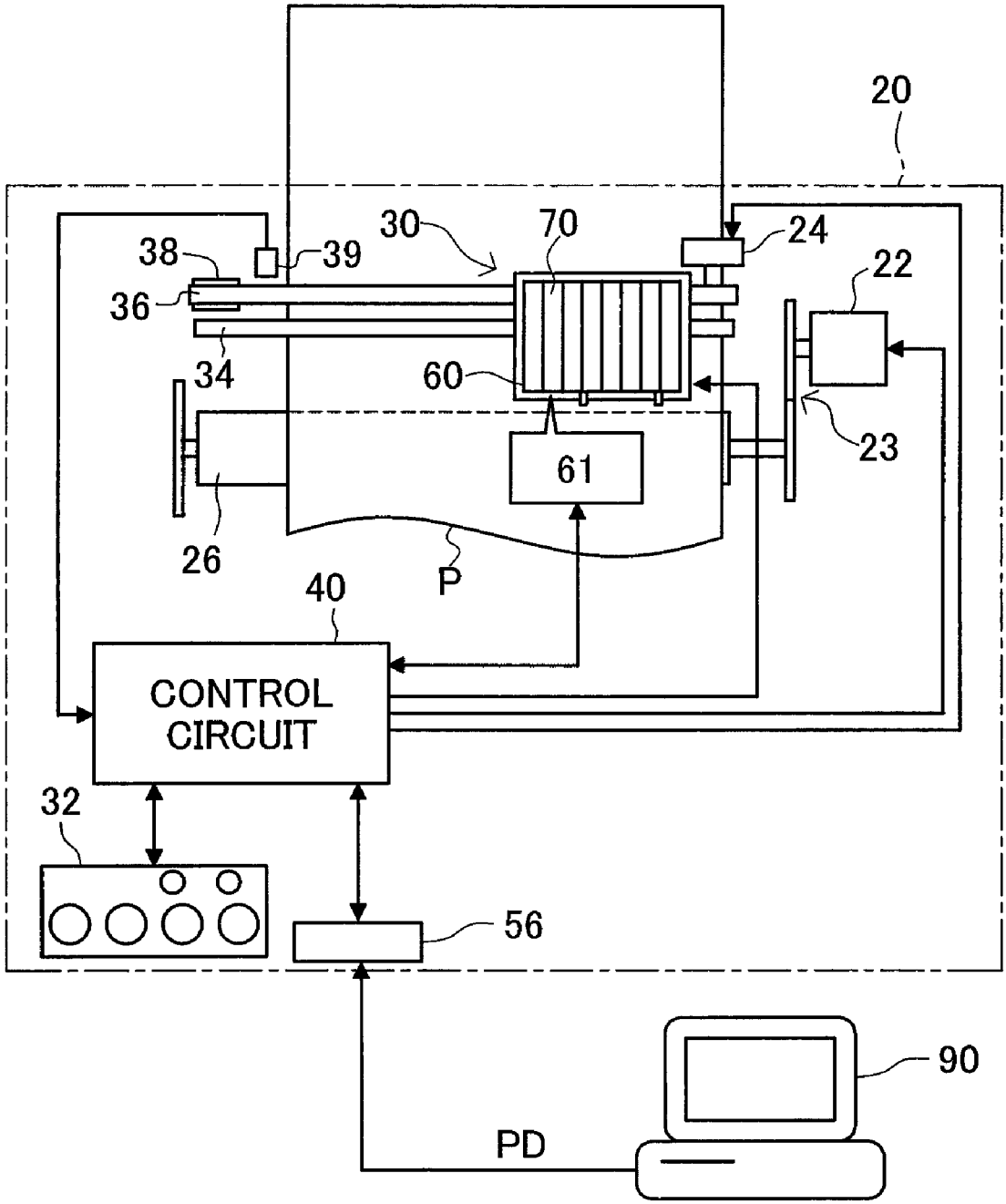
FIG. 1 schematically illustrates the construction of a printing apparatus 20 as a first embodiment.

Construction of Printing Apparatus and Ink Cartridge 70:

FIG. 1 schematically illustrates the construction of a printing apparatus 20 as a first embodiment. It includes a sub-scanning mechanism, a main scanning mechanism, a head driving mechanism, and a control circuit 40. The sub-scanning mechanism feeds the paper P in the sub-scanning direction by paper feed motor 22. The main scanning mechanism reciprocates the carriage 30 in the direction of the axis of a platen 26 (the main scanning direction) by the carriage motor 24. The head driving mechanism drives printing head unit 60 disposed on the carriage 30 to control ink ejection and dot formation. Control circuit 40 governs signal communication with these paper feed motor 22, carriage motor 24, printing head unit 60, and control panel 32. Control circuit 40 is connected to computer 90 via connector 56.

The sub-scanning mechanism for feeding the paper P includes gear train 23 to transmit rotation of the paper feed motor 22 to the platen 26. And the main scanning mechanism for reciprocating the carriage 30 has a sliding shaft 34 that is arranged in parallel with the axis of the platen 26 to hold the carriage 30 in a slidable manner, a pulley 38 that supports an endless drive belt 36 spanned between the carriage motor 24 and the pulley 38, and a position sensor 39 that detects the position of the origin of the carriage 30.

Figure 2:
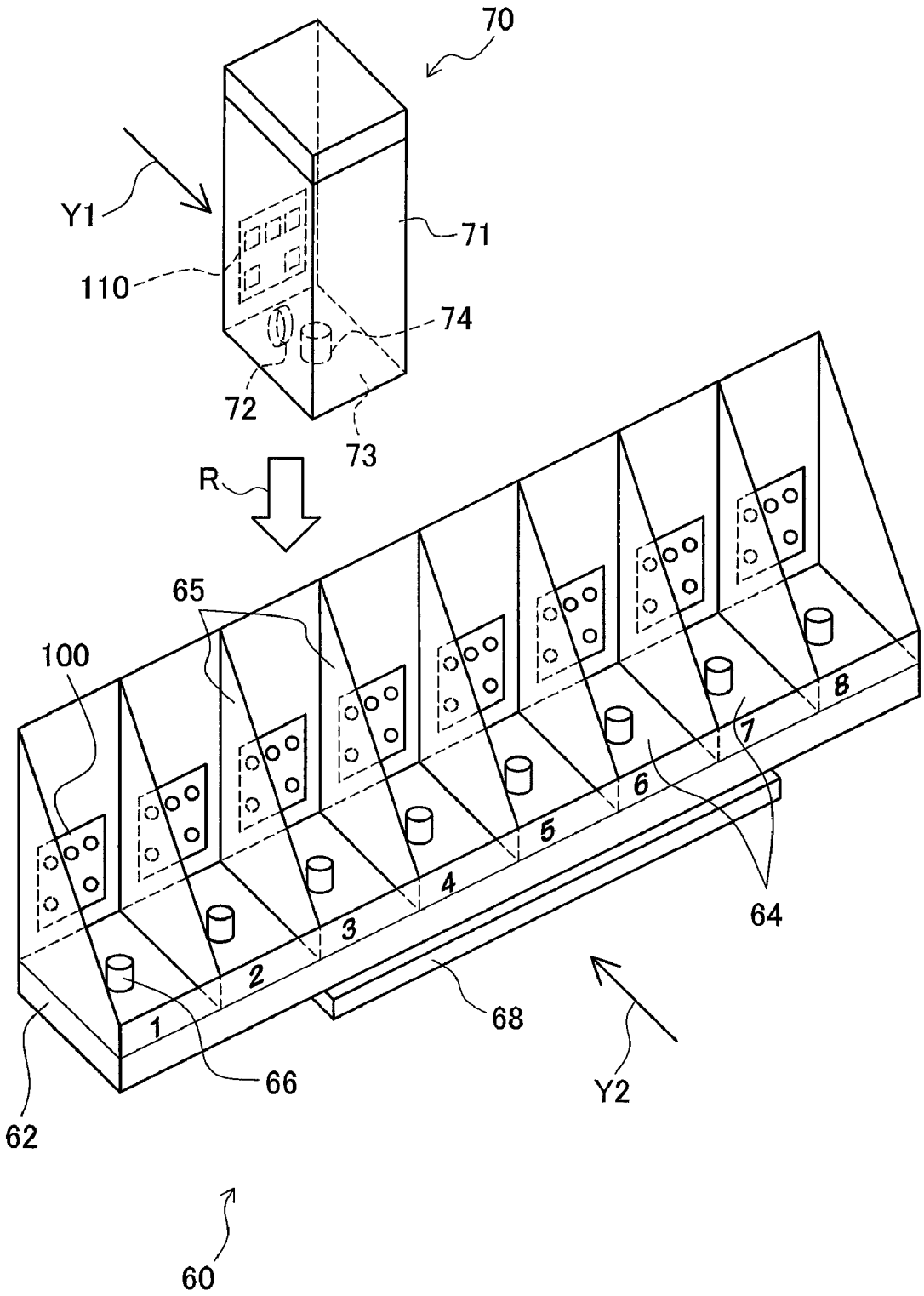
FIG. 2 shows perspective view of printing head unit 60 and ink cartridge 70 attached thereto.

FIG. 2 shows perspective view of printing head unit 60 and ink cartridge 70 attached thereto pertaining to this embodiment. The printing head unit 60 includes cartridge holder 62 to which the plurality of ink cartridge 70 (8 ink cartridge in this embodiment) are able to be attached, printing head 68, and cartridge process dedicated circuit 61 (display is omitted in FIG. 2) that is dedicated circuit to execute the process associated with ink cartridge 70.

The cartridge holder 62 includes guide 65 and same number of ink supply port 66 and terminal board 100 as the number of attachable ink cartridge. The guide 65 has a function to allow the ink cartridge 70 inserted in predetermined insertion direction R and not to allow it in other direction. And the ink cartridge 70 is inserted in predetermined insertion direction R and the position in which the bottom surface 73 of the ink cartridge 70 touches locating face 64 is the fixing position of the ink cartridge 70.

The ink supply port 66 is inserted into ink supply opening 74 described below of the ink cartridge 70 to supply the ink to the printing head 68, when the ink cartridge 70 is attached to the cartridge holder 62. On the terminal board 100, terminals corresponding to some kinds of terminals arranged on circuit board 110 described below of the ink cartridge 70 are disposed.

Next, the ink cartridge 70 is described. As shown in FIG. 2, the ink cartridge 70 is a container that contains one kind of the ink as the printing material. The ink cartridge 70 includes a body 71 that contain the ink therein, a ink supply opening 74 to supply the ink to the printing apparatus 20, a sensor 72 that is used for detection of ink remaining level, and a circuit board 110 on which some kinds of terminals described later are disposed. The ink supply opening 74 is placed on the base of the body 71 and the sensor 72 is placed on the lateral of the body 71.

A piezoelectric actuator is used for the sensor 72 in this embodiment. It is possible to detect the ink remaining level by applying the voltage to the piezoelectric actuator to oscillate the piezoelectric element due to inverse piezoelectric effect and measuring the oscillation frequency of the voltage caused by piezoelectric effect due to residual oscillation thereof. Namely, this oscillation frequency bespeaks characteristic frequency of the surrounding structure (the body 71 and ink) oscillated together with piezoelectric element, and the characteristic frequency changes depending on the ink remaining level. So it is possible to detect the ink remaining level by measuring the oscillation frequency.

The circuit board 110 is mounted on the outer surface parallel to an insertion direction R of the body 71 (direction shown by an arrow R in FIG. 2). Various terminals are accordingly arranged on the body 71 as described later. The circuit board 110 is located in an approximately ½ area of the outer surface (in a lower half area in this embodiment) in the insertion direction, although it may be located in an approximately ⅓ or ¼ area of the outer surface in the insertion direction.

Figure 3:
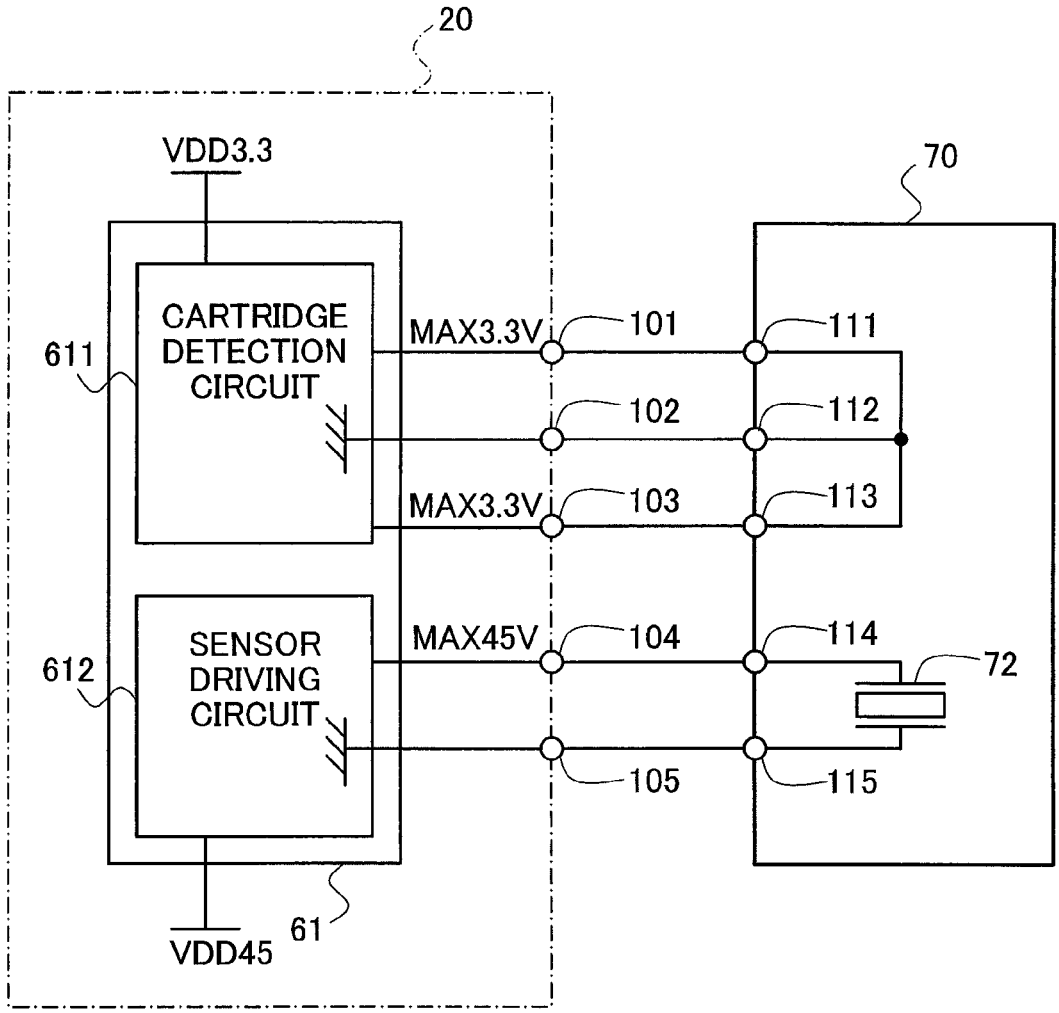
FIG. 3 shows a schematic of electrical construction of ink cartridge 70 and cartridge process dedicated circuit 61.
Figure 3:
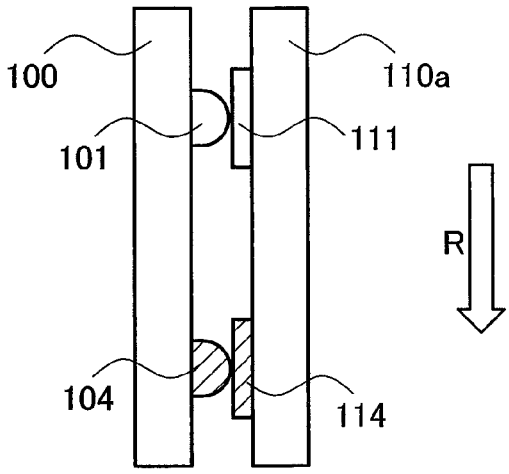

FIG. 3 shows the electrical structure of the ink cartridge 70 and the cartridge processing circuit 61. In FIG. 3(*a*), terminals 101 to 105 are set on the terminal board 100 of the cartridge holder 62, while terminals 111 through 115 are set on the circuit board 110 of the cartridge 70. As shown in FIG. 3(*b*), the terminal board 100 and the circuit board 110 are placed to face each other in attachment of the ink cartridge 70 to the cartridge holder 62. Attachment of the ink cartridge 70 to the cartridge holder 62 causes the terminals on the circuit board 110 of the ink cartridge 70 to come into contact with the terminals on the terminal board 100 of the cartridge holder 62. In the specification hereof, a terminal corresponding to a certain terminal represents the terminal in contact with the certain terminal in attachment of the ink cartridge 70 to the cartridge holder 62. This only regards the terminal in contact with the certain terminal in the normal state and does not include any terminal accidentally in contact with the certain terminal due to improper attachment or ink adhesion. In the illustrated example of FIG. 3(*b*), the terminals 101 and 104 respectively correspond to the terminals 111 and 114.

In the structure of the first embodiment, as shown in FIG. 3(*b*), each terminal (for example, the terminal 101 in FIG. 3(*b*)) on the terminal board 100 of the cartridge holder 62 has a convex cross section protruded in the direction perpendicular to the terminal board 100, while each terminal (for example, the terminal 111 in FIG. 3(*b*)) on the circuit board 110 of the ink cartridge 70 has a flat cross section. The terminal contact structure is, however, not restricted to this example, which requires insertion of the circuit board 110 in the normal direction of the terminal board 100 and the circuit board 110 for their adequate joint (for example, for fitting the convex into the concave like a socket). Any other suitable structure is applicable to ensure the adequate joint (contact) of the terminal board 100 with the circuit board 110 inserted in the direction R.

The cartridge processing circuit 61 is described briefly. As shown in FIG. 3(*a*), the cartridge processing circuit 61 has a cartridge detection circuit 611 that specifies attachment or detachment of the ink cartridge 70 to or from the cartridge holder 62 and identifies the type of the attached ink cartridge 70, and a sensor driving circuit 612 that actuates the sensor 72 of the ink cartridge 70 to measure the remaining quantity of ink in the ink cartridge 70. The cartridge processing circuit 61 also has input and output ports (not shown) to receive and send signals from and to the control circuit 40, as well as other relevant elements. These elements are, however, not characteristic of the present invention and are thus not specifically described here.

The cartridge detection circuit 611 is a lower voltage circuit that is connected with a power supply VCC3.3 and is actuated at a relatively low voltage of 3.3 V. The cartridge detection circuit 611 is linked with the three terminals 101 to 103 (hereafter referred to as cartridge detection circuit terminals). Among the three cartridge detection circuit terminals 101 to 103, the terminals 101 and 103 are connected to the power supply of 3.3 V via a pull-up resistance (not shown) (hereafter referred to as cartridge detection terminals), whereas the terminal 102 is grounded (hereafter referred to as lower-voltage ground terminal). The cartridge detection circuit 611 detects the conduction state of the cartridge detection terminals 101 and 103 with the lower-voltage ground terminal 102 for the specification of attachment or detachment of the ink cartridge 70 and for identification of the type of the ink cartridge 70.

The sensor driving circuit 612 is a higher voltage circuit that is connected with a power supply VCC45 and is actuated at a relatively high voltage of 45 V. The sensor driving circuit 612 is linked with the two terminals 104 and 105 (hereafter referred to as sensor driving circuit terminals). Out of the two sensor driving circuit terminals 104 and 105, the terminal 104 has application of a voltage of 45 V at the maximum by the sensor driving circuit 612 (hereafter referred to as sensor input-output terminal), whereas the other terminal 105 is grounded (hereafter referred to as higher-voltage ground terminal). The sensor driving circuit 612 applies a voltage to the sensor 72 of the ink cartridge 70 via the sensor input-output terminal 104, while detecting a voltage generated by the residual vibration of the sensor 72 via the sensor input-output terminal 104.

In the specification hereof, the terminology 'lower voltage circuit' and 'higher voltage circuit' do not imply the absolute values of voltages but represent one circuit actuated at a preset voltage and another circuit actuated at a higher voltage relative to the preset voltage, like the cartridge detection circuit 611 and the sensor driving circuit 612 described above.

Figure 4:
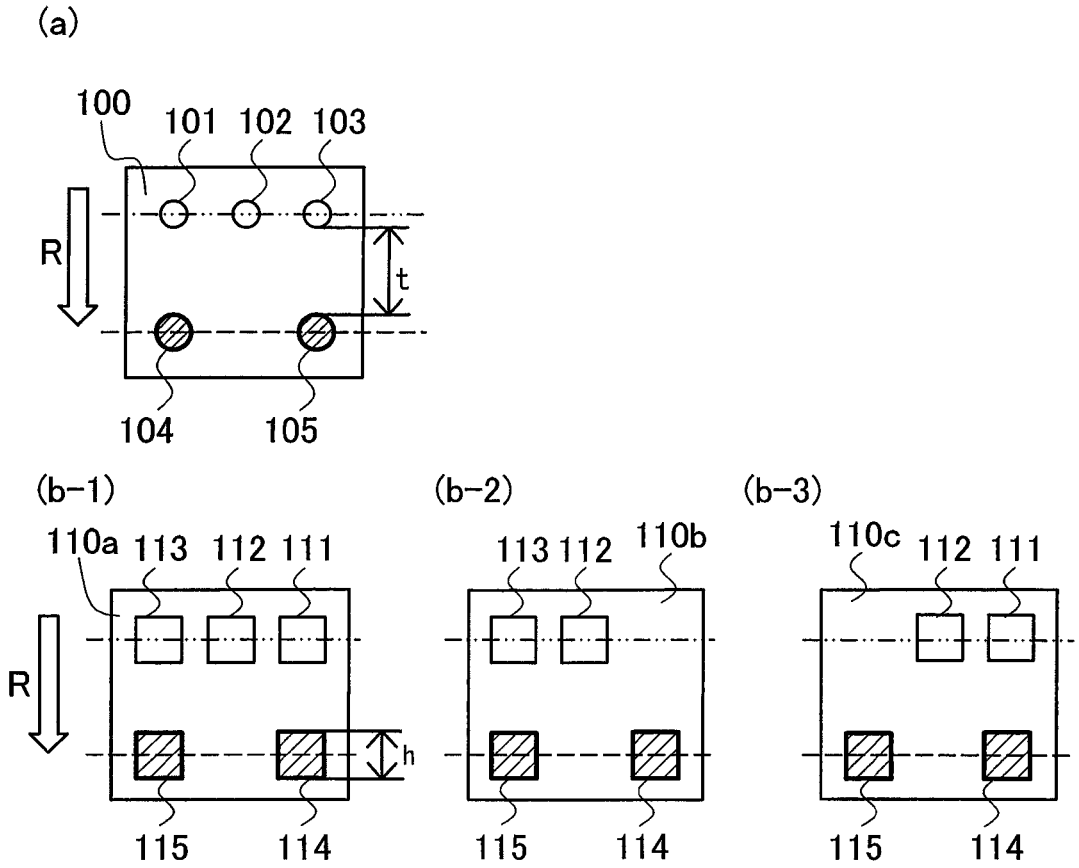
FIG. 4 shows a schematic of terminals on terminal board 100 and circuit board 110 pertaining to the first embodiment.

The terminal arrays are described in detail with reference to FIG. 4. FIG. 4 schematically illustrates the arrangement of terminals on the terminal board 100 of the cartridge holder 62 and the circuit board 110 of the ink cartridge 70 in the first embodiment. FIG. 4(*a*) shows a terminal array on the terminal board 100 of the cartridge holder 62 seen in the direction of an arrow Y2 in FIG. 2. FIG. 4(*b*) shows a terminal array on the circuit board 110 of the ink cartridge 70 seen in the direction of an arrow Y1 in FIG. 2. In FIGS. 4(*a*) and 4(*b*) as well as in FIG. 2, the open arrow R indicates the insertion direction of the ink cartridge 70.

The description first regards the terminals on the terminal board 100 of the cartridge holder 62. Among the five terminals on the terminal board 100, the three cartridge detection circuit terminals 101 to 103 are aligned on a line (line A1) perpendicular to the insertion direction R as shown by the two-dot chain line in FIG. 4(*a*). The two sensor driving circuit terminals 104 and 105 are aligned on a line (line B1) different from the line A1 and perpendicular to the insertion direction R as shown by the broken line in FIG. 4(*a*).

The line B1 of the sensor driving circuit terminals 104 and 105 is located after the line A1 of the cartridge detection circuit terminals 101 to 103 in the insertion direction R. In this embodiment, the insertion direction R of the ink cartridge 70 is downward as shown in FIG. 2, so that the line B1 is located below the line A1.

The description then regards the terminal arrays on the circuit board 110 of the ink cartridge 70. There are three different structures 110*a* to 110*c* of the circuit board 110 as shown in FIGS. 4(*b*-1) to 4(*b*-3). A predetermined structure of the circuit board 110 according to the ink type and the ink quantity is mounted on each ink cartridge 70.

The circuit board 110*a* has three terminals 111 to 113 (hereafter referred to as lower voltage circuit terminals) that respectively correspond to the three terminals 101 to 103 on the terminal board 100 connecting with the cartridge detection circuit 611 (lower voltage circuit), and two terminals 114 and 115 (hereafter referred to as higher voltage circuit terminals) that respectively correspond to the two terminals 104 and 105 on the terminal board 100 connecting with the sensor driving circuit 612 (higher voltage circuit).

Like the three cartridge detection circuit terminals 101 to 103 on the terminal board 100, the three lower voltage circuit terminals 111 to 113 on the circuit board 110*a* are aligned on a line (line A2) perpendicular to the insertion direction R as shown by the two-dot chain line in FIG. 4(*b*-1). The three lower voltage circuit terminals 111 to 113 on the circuit board 110*a* are connected to have a short circuit as shown in FIG. 3.

Like the two sensor driving circuit terminals 104 and 105 on the terminal board 100, the two higher voltage circuit terminals 114 and 115 on the circuit board 110*a* are aligned on a line (line B2) different from the line A2 and perpendicular to the insertion direction R as shown by the broken line in FIG. 4(*b*-1). The two higher voltage circuit terminals 114 and 115 on the circuit board 110*a* are respectively connected to one electrode and the other electrode of the piezoelectric element as the sensor 72 as shown in FIG. 4. Like the positional relation of the line A1 to the line B1 on the terminal board 100, the line B2 is located after the line A2 in the insertion direction R.

In the specification hereof, among the three lower voltage circuit terminals 111 to 113 on the circuit board 110, the terminals 111 and 113 corresponding to the cartridge detection terminals 101 and 103 on the terminal board 100 are called the cartridge detection terminals, while the terminal 112 corresponding to the lower-voltage ground terminal 102 on the terminal board 100 is called the lower-voltage ground terminal. Out of the two higher voltage circuit terminals 114 and 115 on the circuit board 110, the terminal 114 corresponding to the sensor input-output terminal 104 on the terminal board 100 is called the sensor input-output terminal, while the terminal 115 corresponding to the higher-voltage ground terminal 105 on the terminal board 100 is called the higher-voltage ground terminal.

A length 'h' of the higher voltage circuit terminals 114 and 115 in the insertion direction R on the circuit board 110*a* (see FIG. 3(*b*-1) is shorter than an inter-terminal distance 't' (see FIG. 3(*a*)) between the corresponding sensor driving circuit terminals 104 and 105 and the cartridge detection circuit terminals 101 to 103 (located on the upper line in the insertion direction R) on the terminal board 100. For example, the length 'h' may be about ⅓ to ¾ of the inter-terminal distance 't'.

The circuit board 110*b* does not have one 111 of the cartridge detection terminals, whereas the circuit board 110*c* does not have the other 113 of the cartridge detection terminals 113. Otherwise the circuit boards 110*b* and 110*c* have the similar structures to that of the circuit board 110*a* described above.

In the ink cartridge 70 of the first embodiment, the lower voltage circuit terminals 111 to 113 are aligned on the line A2, and the higher voltage circuit terminals 114 and 115 are aligned on the line B2 different from the line A2. The line B2 of the higher voltage circuit terminals 114 and 115 is located after the line A2 of the lower voltage circuit terminals 111 to 113 in the insertion direction R. While the position of the ink cartridge 70 is deviated from the proper attachment position in the direction opposite to the insertion direction R, for example, in the course of attachment, in the course of detachment, or in the event of improper attachment (for example, when the ink cartridge 70 is positioned above the proper attachment position), the lower voltage circuit terminals 111 to 113 of the ink cartridge 70 are farther from the sensor driving circuit terminals 104 and 105 of the printing apparatus 20. The lower voltage circuit terminals 111 to 113 (the cartridge detection terminals and the lower-voltage ground terminal) of the ink cartridge 70 accordingly do not come into contact with the sensor driving circuit (higher voltage circuit) terminals 104 and 105 (the sensor input-output terminal and the higher-voltage ground terminal) of the printing apparatus 20. The ink cartridge 70 is inserted in the insertion direction R to a preset end position to be properly attached. The attachment position of the ink cartridge 70 is thus not deviated farther in the insertion direction R. This arrangement effectively prevents a short circuit between the terminals of different voltages, thus protecting the ink cartridge 70 and the printing apparatus 20 from potential damages induced by the short circuit.

The length 'h' of the higher voltage circuit terminals 114 and 115 in the insertion direction R of the ink cartridge 70 is shorter than the inter-terminal distance 't' between the corresponding sensor driving circuit terminals 104 and 105 and the cartridge detection circuit terminals 101 to 103 (located on the upper line in the insertion direction R) of the printing apparatus 20. While the position of the ink cartridge 70 is deviated from the proper attachment position in the direction opposite to the insertion direction R, for example, in the course of attachment, in the course of detachment, or in the event of improper attachment, the sensor driving circuit (higher voltage circuit) terminals 104 and 105 and the cartridge detection circuit (lower voltage circuit) terminals 101 to 103 of the printing apparatus 20 are not interconnected (bridged) to cause a short circuit by the higher voltage circuit terminals 114 and 115 of the ink cartridge 70. This arrangement ensures effective prevention of a short circuit between the terminals of different voltages.

In the event of ink leakage, ink is often leaked in the vertical direction of the ink cartridge 70, that is, from the upper cartridge cover or from the lower ink supply opening, to cause ink adhesion to the terminals on the outside of the ink cartridge 70. The ink cartridge 70 has the lower voltage circuit terminals located in the upper portion and the higher voltage circuit terminals located in the lower portion. The vertical ink leakage thus preferentially causes a short circuit between the terminals of an identical voltage and desirably prevents a short circuit between the terminals of different voltages, which has the higher potential for the severer damage.

In the printing apparatus 20 of this embodiment, the sensor driving circuit terminals 104 and 105 are located in the lower portion of the cartridge holder 62. Any foreign substance (for example, a paperclip) that may cause a short circuit between terminals hardly reaches the position of contact with the sensor driving circuit terminals 104 and 105. This arrangement effectively prevents a short circuit between the sensor driving circuit (higher voltage circuit) terminals 104 and 105 and the other terminals, which has the higher potential for the severer damage.

Modification of First Embodiment

Figure 5:
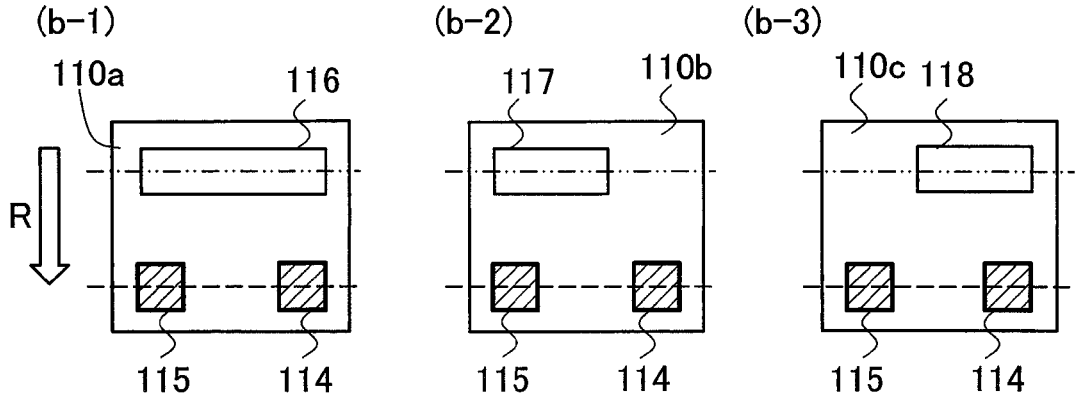
FIG. 5 shows a schematic of circuit board 110 of ink cartridge 70 pertaining to other aspect of the first embodiment.

FIG. 5 shows another applicable structure of the circuit board 110 on the ink cartridge 70 in one modified example of the embodiment. The primary difference from the circuit board 110 of the embodiment is that multiple lower voltage circuit terminals are integrated to one flat plate terminal. The three lower voltage circuit terminals 111 to 113 on the circuit board 110*a* are replaced by one flat plate terminal 116. The two lower voltage circuit terminals 112 and 113 on the circuit board 110*b* and the two lower voltage circuit terminals 111 and 112 on the circuit board 110*c* are respectively replaced by one flat plate terminal 117 and by one flat plate terminal 118. The flat plate terminal may be made of SUS (stainless steel) or plated SUS.

This modification has the following advantage in addition to the advantages of the embodiment using the separate lower voltage circuit terminals. The structure of the modified example does not require the wiring for connection of the individual terminals and reduces the total number of parts of the ink cartridge 70.

B. Second Embodiment

Figure 6:
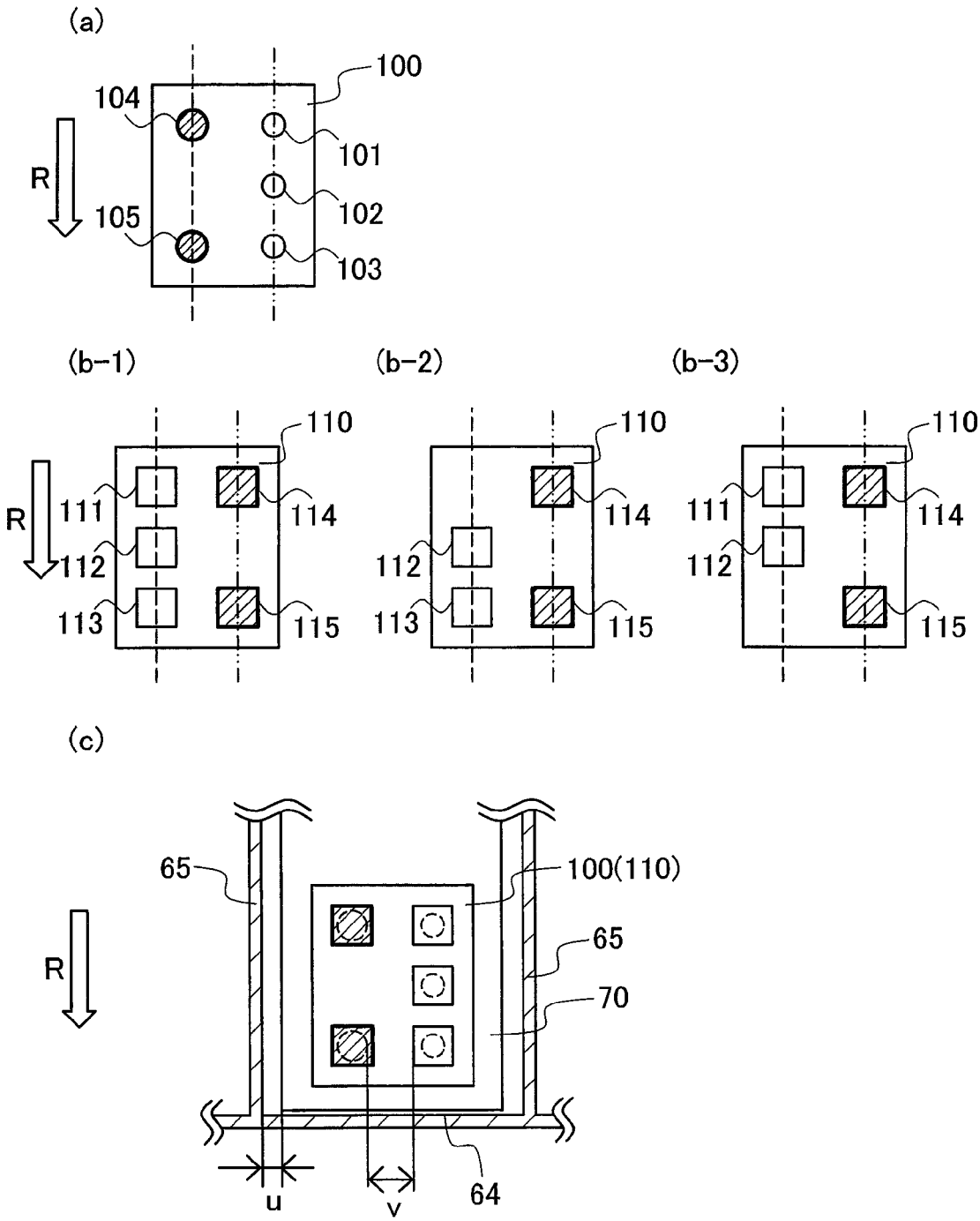
FIG. 6 shows a schematic of terminals on terminal board 100 and circuit board 110 pertaining to the second embodiment.

A second embodiment of the invention is described below with reference to FIG. 6. FIG. 6 schematically illustrates the arrangement of terminals on the terminal board 100 of the cartridge holder 62 and the circuit board 110 of the ink cartridge 70 in the second embodiment.

The primary difference from the first embodiment is the terminal arrays on the terminal board 100 and the circuit board 110. The structure of the second embodiment is otherwise similar to that of the first embodiment and is thus not specifically described here. The following description regards only the terminal arrays.

In the structure of the second embodiment, the three cartridge detection circuit terminals 101 to 103 on the terminal board 100 are aligned on a line (line C1) parallel to the insertion direction R as shown by the two-dot chain line in FIG. 6(*a*). The two sensor driving circuit terminals 104 and 105 on the terminal board 100 are aligned on a line (line D1) different from the line C1 and parallel to the insertion direction R as shown by the broken line in FIG. 6(*a*). In the illustrated example of FIG. 6(*a*), the line C1 of the cartridge detection circuit terminals 101 to 103 is located on the right, while the line D1 of the sensor driving circuit terminals 104 and 105 is located on the left. This positional relation may be inverted.

The terminal array on the circuit board 110 is determined corresponding to the terminal array on the terminal board 100. The two or the three lower voltage circuit terminals 111 to 113 on the circuit board 110 are aligned on a line (line C2) parallel to the insertion direction R as shown by the two-dot chain line in FIGS. 6(*b*-1), 6(*b*-2), and 6(*b*-3). Like the two sensor driving circuit terminals 104 and 105 on the terminal board 100, the two higher voltage circuit terminals 114 and 115 on the circuit board 110 are aligned on a line (line D2) different from the line C2 and parallel to the insertion direction R as shown by the broken line in FIGS. 6(*b*-1), 6(*b*-2), and 6(*b*-3).

FIG. 6(*c*) shows the ink cartridge 70 set in the proper attachment position in the second embodiment. In the proper attachment position of FIG. 6(*c*), an inter-terminal distance 'v' in the direction perpendicular to the insertion direction R between the lower voltage circuit terminals 111 and 113 on the circuit board 110 and the sensor driving circuit terminals 104 and 105 on the terminal board 100 is longer than a clearance (allowance) 'u' between the ink cartridge 70 and the guide 65 for guiding the insertion of the ink cartridge 70. For example, the clearance 'u' is about 0.5 to 3 mm, whereas the inter-terminal distance 'v' is about 4 to 10 mm.

In the ink cartridge 70 of the second embodiment, the lower voltage circuit terminals 111 to 113 are aligned on the line C2, and the higher voltage circuit terminals 114 and 115 are aligned on the line D2 different from the line C2. While the position of the ink cartridge 70 is deviated from the proper attachment position in the direction opposite to the insertion direction R, for example, in the course of attachment, in the course of detachment, or in the event of improper attachment, there is only a contact between the terminals of an identical voltage aligned in parallel to the insertion direction R. There is accordingly no accidental contact of the higher voltage circuit terminals 114 and 115 or the sensor driving circuit terminals 104 and 105 with the lower voltage circuit terminals 111 to 113 or with the cartridge detection circuit terminals 101 to 103. This arrangement effectively prevents a short circuit between the terminals of different voltages.

C. Third Embodiment

Figure 7:
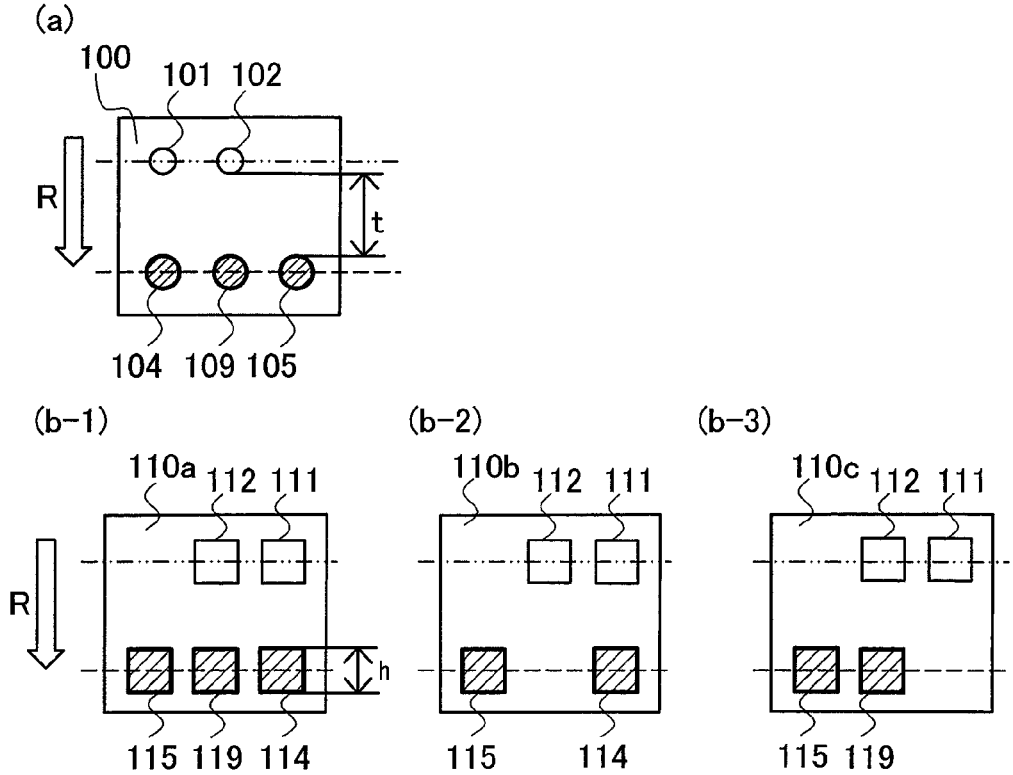
FIG. 7 shows a schematic of terminals on terminal board 100 and circuit board 110 pertaining to the third embodiment.
Figure 8:
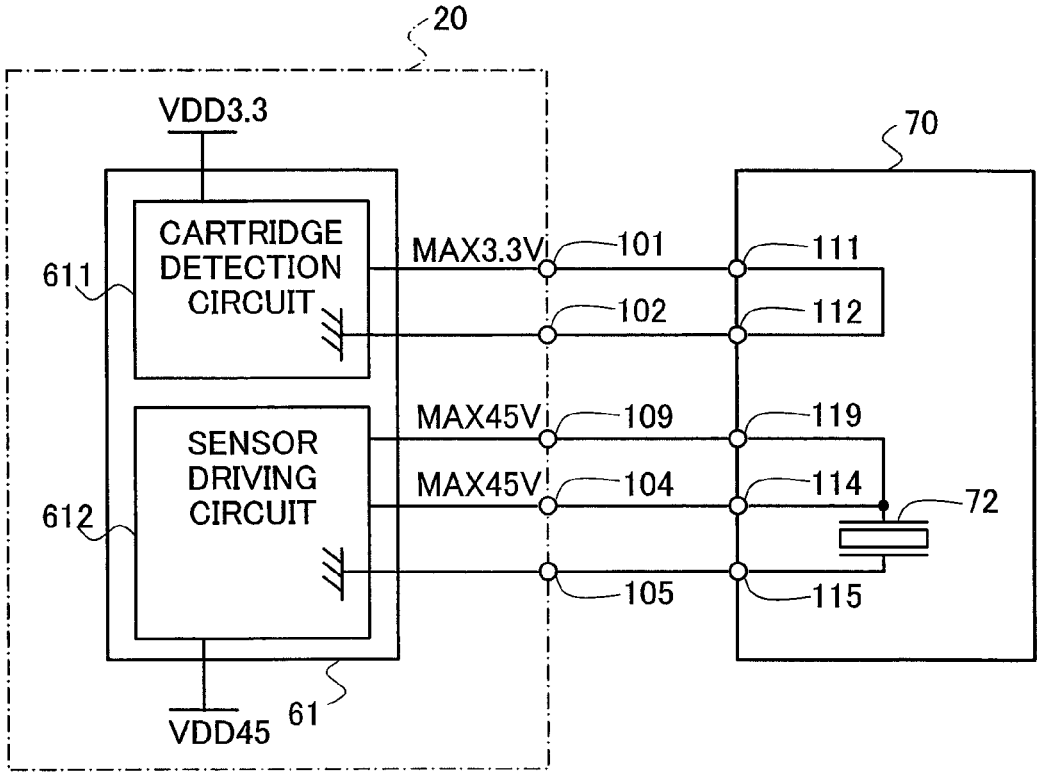
FIG. 8 shows a schematic of electrical construction of ink cartridge 70 and cartridge process dedicated circuit 61 pertaining to the third embodiment.

A third embodiment of the invention is described below with reference to FIGS. 7 and 8. FIG. 7 schematically illustrates the arrangement of terminals on the terminal board 100 of the cartridge holder 62 and the circuit board 110 of the ink cartridge 70 in the third embodiment. FIG. 8 schematically shows the electrical structure of the ink cartridge 70 and the cartridge processing circuit 61 in the third embodiment.

The primary difference from the first embodiment is three higher voltage circuit terminals and two lower voltage circuit terminals on both the terminal board 100 and the circuit board 110 and a corresponding change of the electrical structure (wiring).

As shown in FIG. 7(*a*), the terminal board 100 of the third embodiment has only two cartridge detection circuit terminals, that is, one cartridge detection terminal 101 and one lower-voltage ground terminal 102. As shown in FIGS. 7(*b*-1) to 7(*b*-3), the circuit board 110 correspondingly has only two lower voltage circuit terminals, that is, one cartridge detection terminal 111 and one lower-voltage ground terminal 112. The terminal board 100 has three sensor driving circuit terminals, that is, two sensor input-output terminals 104 and 109 and one higher-voltage ground terminal 104.

There are three different structures 110*a*, 110*b*, and 110*c* of the circuit board 110 corresponding to the different arrangements of the higher voltage circuit terminals. The circuit board 110*a* has three higher voltage circuit terminals, that is, two sensor input-output terminals 114 and 119 and one higher-voltage ground terminal 115. The circuit board 110*b* does not have one 119 of the two sensor input-output terminals, whereas the circuit board 110*c* does not have the other 114 of the two sensor input-output terminals. Otherwise the circuit boards 110*b* and 110*c* have the similar structures to that of the circuit board 110*a* described above.

As shown in FIG. 7(*c*), the sensor driving circuit 612 has the connection to apply the driving voltage to the sensor 72 via either of the two sensor input-output terminals 109 and 104 and to detect a voltage generated by the residual vibration of the sensor 72 via either of the two sensor input-output terminals 109 and 104.

The third embodiment has the similar fundamental structure to that of the first embodiment with only the difference in numbers of the respective terminals and accordingly exerts the similar functions and effects to those of the first embodiment.

D. Fourth Embodiment

Figure 9:
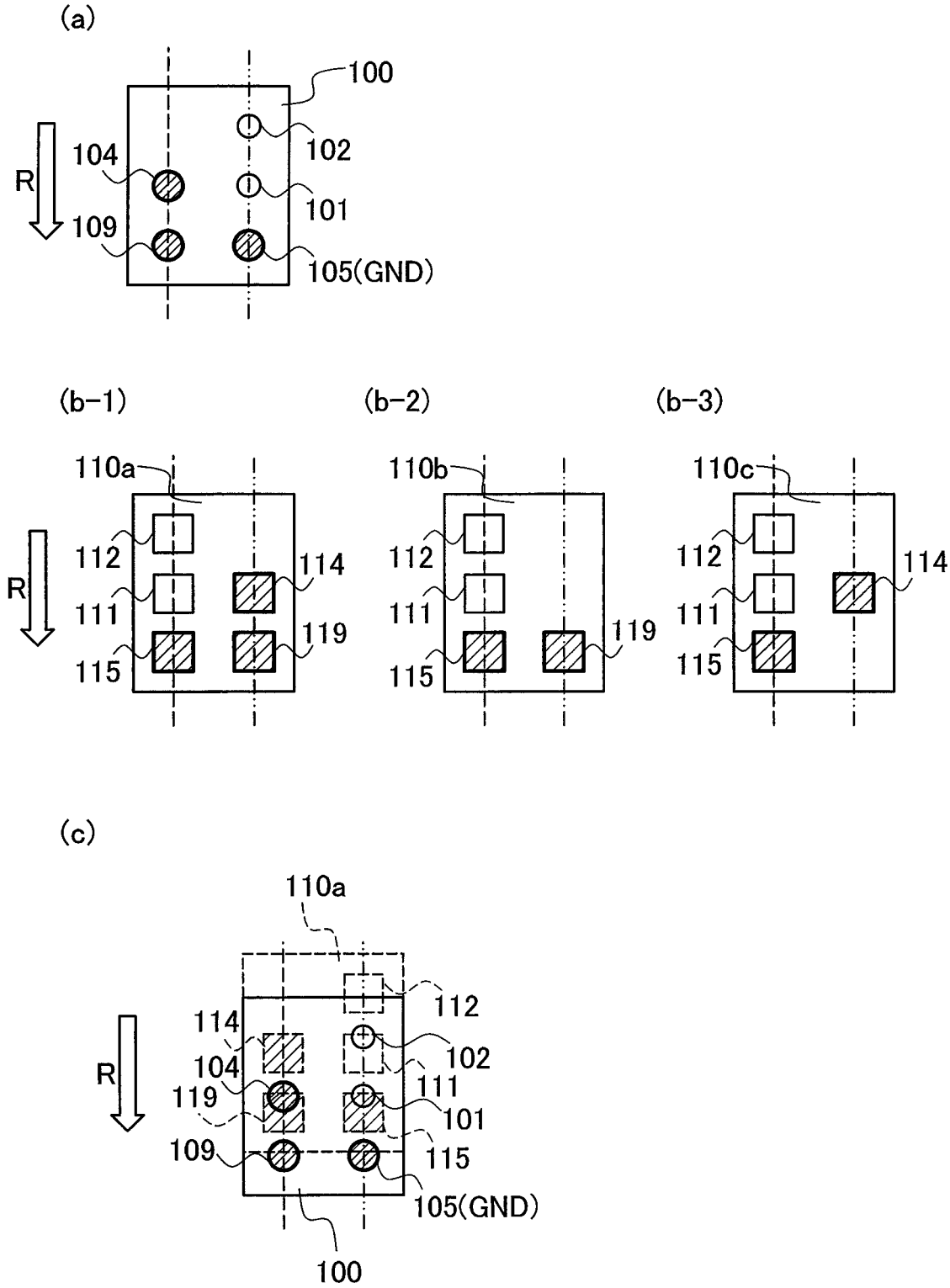
FIG. 9 shows a schematic of terminals on terminal board 100 and circuit board 110 pertaining to the fourth embodiment.

A fourth embodiment of the invention is described below with reference to FIG. 9. FIG. 9 schematically illustrates the arrangement of terminals on the terminal board 100 of the cartridge holder 62 and the circuit board 110 of the ink cartridge 70 in the fourth embodiment.

The numbers of the respective terminals on and the electrical structure of the terminal board 100 and the circuit board 110 in the fourth embodiment are similar to those of the third embodiment. The primary difference from the third embodiment is the terminal arrays.

In the structure of the fourth embodiment, the two cartridge detection circuit terminals 101 and 102 on the terminal board 100 are aligned on a line (line C1 like the second embodiment) parallel to the insertion direction R as shown by the two-dot chain line in FIG. 9(*a*). The higher-voltage ground terminal 105 is located on the same line C1 after the cartridge detection circuit terminals 101 and 102 in the insertion direction R. The two sensor input-output terminals 104 and 109 as the remaining sensor driving circuit terminals are aligned on a line (line D1 like the second embodiment) different from the line C1 and parallel to the insertion direction R as shown by the broken line in FIG. 9(*a*).

In the structure of the fourth embodiment, while the position of the ink cartridge 70 is deviated from the proper attachment position in the direction opposite to the insertion direction R, for example, in the course of attachment, in the course of detachment, or in the event of improper attachment, the higher-voltage ground terminal 115 of the ink cartridge 70 may come into contact with one of the cartridge detection circuit terminals (for example, the terminal 101) of the printing apparatus 20. In this event, a high voltage may temporarily be applied from the sensor input-output terminal 114 or 119 connecting with the higher-voltage ground terminal 115 to the cartridge detection circuit terminal of the printing apparatus 20 in contact with the higher-voltage ground terminal 115. This event is described in detail below.

FIG. 9(*c*) shows the positional relation between the terminal board 100 and the circuit board 110 in the event of deviation of the ink cartridge 70 from the proper attachment position in the direction opposite to the insertion direction R in the fourth embodiment. In this illustrated example, the higher-voltage ground terminal 115 of the ink cartridge 70 is accidentally in contact with the cartridge detection circuit terminal 101 of the printing apparatus 20. The sensor input-output terminal 104 of the printing apparatus 20 that may have application of a high voltage of 45 V at the maximum is accidentally in contact with the sensor input-output terminal 119 of the ink cartridge 70. When the sensor driving circuit 612 applies a high voltage to the sensor input-output terminal 104, the high voltage is applied to the cartridge detection circuit terminal 101 via the path of the sensor input-output terminal 104—the sensor input-output terminal 119—the higher-voltage ground terminal 115—the cartridge detection circuit terminal 101.

As shown in FIG. 8, a piezoelectric element or a type of capacitor is connected as the sensor 72 between the sensor input-output terminal 119 and the higher-voltage ground terminal 115. In the state of FIG. 9(*c*), the high voltage is momentarily applied to the cartridge detection circuit terminal 101. The charge accumulation in the capacitor (sensor 72), however, causes a voltage drop across the capacitor and immediately lowers the voltage applied to the cartridge detection circuit terminal 101. This arrangement effectively prevents or at least relives the potential damage of the cartridge detection circuit 611 or the lower voltage circuit caused by the accidental contact.

The sensor 72 provided for measuring the remaining quantity of ink is also used as the capacitor to have the function of preventing or at least relieving the potential damage of the circuit structure. This structure desirably prevents or at least relieves the potential damage of the lower voltage circuit without increasing the total number of parts.

E. Modifications

The positions of the higher voltage circuit terminals or the positions of the lower voltage circuit terminals may be exchanged arbitrarily, except the positions of the higher-voltage ground terminals 105 and 115 in the fourth embodiment and the positions of the lower-voltage ground terminals 102 and 112 in the first embodiment. Such positional exchange does not affect the functions and the effects of the present invention described above.

Like the modified example of the first embodiment, the multiple lower voltage circuit terminals on the circuit board 110 of the ink cartridge 70 in the second through the fourth embodiments may be integrated to one flat plate terminal. Such modification advantageously reduces the total number of parts like the modified example of the first embodiment, in addition to the functions and the effects of the second through the fourth embodiments described above.

The above embodiments regard application of the present invention to the ink cartridge 70 and to the printing apparatus 20 with the corresponding attachment structure. The technique of the invention is, however, not restricted to the ink cartridge but may be applied to a container of another printing material, for example, a toner cartridge, and to a printing apparatus with a corresponding attachment structure.

While the present invention has been described on the basis of the embodiment and variations, these embodiment and variations of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

The invention claimed is:

1. A printing material container attachable to a printing apparatus by being inserted in a predetermined insertion direction, the printing material container comprising:

a body that contains a printing material;

a plurality of low voltage circuit terminals respectively configured to contact a plurality of terminals of a low voltage circuit provided with the printing apparatus at first positions when the printing material container is attached to the printing apparatus, the low voltage circuit including a container detection circuit for detecting a type of printing material container or whether the printing material container is attached and the plurality of low voltage circuit terminals includes one earth terminal and one or two container detection terminals; and a plurality of high voltage circuit terminals respectively configured to contact a plurality of terminals of a high voltage circuit provided with the printing apparatus at second positions when the printing material container is attached to the printing apparatus, wherein the second positions are arranged further towards the insertion direction side than the first positions.

2. A printing material container according to claim 1, wherein a width of the high voltage circuit terminal in the insertion direction is shorter than a distance between the terminal of the high voltage circuit corresponding to the high voltage circuit terminal and the terminal of the low voltage circuit located in a backward direction of the insertion direction as seen from the high voltage circuit terminal.

3. A printing material container according to claim 1, wherein the plurality of low voltage circuit terminals are arranged so as to form a first row on the body, wherein the first row is orthogonal to the insertion direction, and wherein the plurality of high voltage circuit terminals are arranged so as to form a second row on the body, wherein the second row is orthogonal to the insertion direction and is arranged further towards the insertion direction than the first row.

4. A printing material container attachable to a printing apparatus by being inserted in a predetermined insertion direction, the printing material container comprising:

a body that contains a printing material;

a plurality of low voltage circuit terminals arranged so as to form a first row on the body, wherein the first row is parallel to the insertion direction, wherein the plurality of low voltage circuit terminals respectively contact a plurality of terminals of a low voltage circuit provided with the printing apparatus when the printing material container is attached to the printing apparatus, the low voltage circuit including a container detection circuit for detecting a type of printing material container or whether the printing material container is attached and the plurality of low voltage circuit terminals includes one earth terminal and one or two container detection terminals; and a plurality of high voltage circuit terminals arranged so as to form a second row on the body, wherein the second row is parallel to the insertion direction and is different from first row, wherein the plurality of high voltage circuit terminals respectively contact a plurality of terminals of a high voltage circuit provided with the printing apparatus when the printing material container is attached to the printing apparatus.

5. A printing material container according to claim 1 or claim 4 further comprises a sensor for detecting a status of the printing material, wherein the high voltage circuit is a sensor driving circuit for driving the sensor, and wherein the plurality of high voltage circuit terminals include one or two sensor input-output terminals and one earth terminal.

6. A printing material container attachable to a printing apparatus by being inserted in a predetermined insertion direction, the printing material container comprising:

a body that contains a printing material;

a plurality of low voltage circuit terminals arranged so as to form a first row on the body, wherein the first row is parallel to the insertion direction, wherein the plurality of low voltage circuit terminals respectively contact a plurality of terminals of a low voltage circuit provided with the printing apparatus when the printing material container is attached to the printing apparatus; and a plurality of high voltage circuit terminals arranged on the body, wherein the plurality of high voltage circuit terminals respectively contact a plurality of terminals of a high voltage circuit provided with the printing apparatus when the printing material container is attached to the printing apparatus, wherein the plurality of high voltage circuit terminals include one earth terminal, wherein the one earth terminal is arranged on the first row and is arranged further towards the insertion direction side than the plurality of low voltage circuit terminals, wherein a other terminal among the plurality of high voltage circuit terminals except the one earth terminal is arranged so as to form a second row that is parallel to the insertion direction and is different from first row, wherein the one earth terminal is connected with the other terminal forming the second row via a capacitor.

7. A printing material container according to claim 6, wherein the capacitor includes a piezoelectric element for a sensor to detect a status of the printing material, and wherein the high voltage circuit is a sensor driving circuit for driving the sensor.

8. A printing material container according to any one of claim 1, claim 4 and claim 6, wherein the low voltage circuit includes a container detection circuit for detecting a type of the printing material container or whether the printing material container is attached, wherein the plurality of low voltage circuit terminals includes one earth terminal and two container detection terminals, wherein a arrangement of the plurality of low voltage circuit terminals on the first row is one container detection terminal, the one earth terminal and another container detection terminal, in that order.

9. A printing material container according to claim 8, wherein the one or two container detection terminal and the one earth terminal are integrally formed by a single component.

10. A printing apparatus comprising a printing material container holder having terminals respectively corresponding to the plurality of low voltage terminals and the plurality of high voltage terminals provided with a printing material container according to any one of claim 1, claim 4 and claim 6.

11. A printing material container according to claim 6, wherein the one or two container detection terminal and the one earth terminal are integrally formed by a single component.

* * * * *